US010947769B2

(12) United States Patent
Haberberger

(10) Patent No.: US 10,947,769 B2
(45) Date of Patent: Mar. 16, 2021

(54) ASSEMBLY GROUP FOR ADJUSTING AN ADJUSTMENT ELEMENT RELATIVE TO A STATIONARY SECTION OF A VEHICLE

(71) Applicant: Brose Fahrzeugteile GmbH & Co. Kommanditgesellschaft, Bamberg, Bamberg (DE)

(72) Inventor: Christoph Haberberger, Gößweinstein (DE)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 254 days.

(21) Appl. No.: 16/044,144

(22) Filed: Jul. 24, 2018

(65) Prior Publication Data

US 2019/0128041 A1 May 2, 2019

(30) Foreign Application Priority Data

Oct. 30, 2017 (DE) ..... 10 2017 125 433.1

(51) Int. Cl.
*E05F 15/41* (2015.01)
*E05F 15/77* (2015.01)
(Continued)

(52) U.S. Cl.
CPC ..... *E05F 15/41* (2015.01); *E05F 15/622* (2015.01); *E05F 15/627* (2015.01); *E05F 15/77* (2015.01);
(Continued)

(58) Field of Classification Search
CPC ..... E05Y 2900/531; E05Y 2201/216; E05Y 2400/31; E05F 15/40; E05F 15/622;
(Continued)

(56) References Cited

U.S. PATENT DOCUMENTS 9,174,517 B2 * 11/2015 Scheuring ..... B60J 5/047
9,868,340 B2 * 1/2018 Nishikibe ..... E05F 1/002
(Continued)

FOREIGN PATENT DOCUMENTS

CN 104859409 A 8/2015
CN 105358785 A 2/2016
(Continued)

OTHER PUBLICATIONS

Chinese First Office action dated May 8, 2020 issued in corresponding Chinese Application No. 201811268139.9, 6 pages, with translation, 3 pages.

*Primary Examiner* — Justin B Rephann
(74) *Attorney, Agent, or Firm* — Lewis Roca Rothgerber Christie LLP

(57) ABSTRACT

It is provided an assembly for adjusting an adjustment element relative to a stationary section of a vehicle, in particular a vehicle door relative to a vehicle body, which comprises a drive motor for electromotively adjusting the adjustment element, an electrically actuatable coupling device, a sensor device for measuring an acceleration value of the adjustment element during an adjustment of the adjustment element, and a control device for controlling the drive motor and the coupling device. The control device is configured to calculate a force value or torque value acting on the coupling device with reference to an acceleration value obtained via the sensor device during an adjustment of the adjustment element in a slip state of the coupling device.

13 Claims, 6 Drawing Sheets

(51) Int. Cl.
*E05F 15/622* (2015.01)
*E05F 15/627* (2015.01)

(52) U.S. Cl.
CPC ... *E05Y 2201/434* (2013.01); *E05Y 2900/531* (2013.01)

(58) Field of Classification Search
CPC ..... E05F 15/611; E05F 15/60; E05F 15/41; E05F 15/627; E05F 15/77
See application file for complete search history.

(56) References Cited

U.S. PATENT DOCUMENTS

| | | | | |
|---|---|---|---|---|
| 10,017,976 | B2 * | 7/2018 | Herrmann | E05F 15/40 |
| 10,443,287 | B2 | 10/2019 | Elie et al. | |
| 2003/0050151 | A1 * | 3/2003 | Fukumura | E05F 15/73 477/174 |
| 2012/0245800 | A1 * | 9/2012 | Koberstaedt | E05F 15/622 701/49 |
| 2014/0150581 | A1 | 6/2014 | Scheuring et al. | |
| 2015/0233167 | A1 | 8/2015 | Natsui et al. | |
| 2015/0240548 | A1 | 8/2015 | Bendel et al. | |
| 2015/0330134 | A1 * | 11/2015 | Bendel | E05D 11/087 701/49 |
| 2016/0348413 | A1 * | 12/2016 | Broadhead | E05F 15/40 |
| 2016/0369551 | A1 | 12/2016 | Suzuki et al. | |
| 2017/0247927 | A1 * | 8/2017 | Elie | E05F 15/611 |
| 2017/0335615 | A1 | 11/2017 | Herrmann et al. | |
| 2018/0216392 | A1 * | 8/2018 | Rietdijk | F16D 51/00 |
| 2018/0291666 | A1 * | 10/2018 | Linden | E05F 15/73 |
| 2018/0370591 | A1 * | 12/2018 | Denninger | E05F 15/60 |
| 2019/0203517 | A1 * | 7/2019 | Herrmann | E05F 15/41 |
| 2019/0301226 | A1 * | 10/2019 | Kaburaki | E05D 3/127 |

FOREIGN PATENT DOCUMENTS

| | | | |
|---|---|---|---|
| CN | 106404011 | A | 2/2017 |
| DE | 102009037400 | A1 | 2/2011 |
| DE | 102011055506 | A1 | 5/2013 |
| DE | 102012018093 | A1 | 3/2014 |
| DE | 112012003117 | T5 | 4/2014 |
| DE | 102015215627 | A1 | 2/2017 |
| DE | 102016200830 | A1 | 7/2017 |
| DE | 102016208438 | | 11/2017 |
| JP | 5932469 | B2 | 6/2016 |
| WO | WO2017/029163 | A1 | 2/2017 |

* cited by examiner

ASSEMBLY GROUP FOR ADJUSTING AN ADJUSTMENT ELEMENT RELATIVE TO A STATIONARY SECTION OF A VEHICLE

REFERENCE TO RELATED APPLICATION

This application claims priority to German Patent Application No. 10 2017 125 433.1 filed on Oct. 30, 2017, the entirety of which is incorporated by reference herein.

BACKGROUND

The invention relates to an assembly for adjusting an adjustment element relative to a stationary section of a vehicle and to a method for adjusting an adjustment element relative to a stationary section of a vehicle.

Such an adjustment element for example can be realized by a vehicle door, for example a vehicle side door or a liftgate of a vehicle. Such a vehicle door can be moved relative to a vehicle body, in order to clear a vehicle opening. The vehicle door for example can be pivotally arranged on the vehicle body. It likewise is conceivable and possible, however, that the vehicle door is shiftably arranged on the vehicle body.

Such an assembly comprises a drive motor for electromotively adjusting the adjustment element and an electrically actuatable coupling device that includes a coupling element for coupling the drive motor to a transmission element for adjusting the adjustment element. The coupling element in particular can be switched into a coupling state in which a coupling exists between the drive motor and the transmission element for adjusting the adjustment element. The coupling element can, however, also be switched into a sliding slip state in which the coupling element cooperates with a further coupling element or with the transmission element such that a slip exists between the coupling elements or the coupling element and the transmission element, so that a rotary movement of the drive motor is not completely converted into an adjusting movement of the adjustment element.

In addition, a sensor device serves for measuring an acceleration value that indicates an acceleration of the adjustment element during the adjustment. A control device is provided in order to control the drive motor and the locking device.

Via such an assembly an adjustment element, for example a vehicle door, can be adjusted electromotively. Via the assembly, braking of the adjustment element, for example to limit a speed of movement when manually moving the adjustment element or to provide a so-called end stop damping, can be effected in that the coupling device is switched into its sliding slip state and thus effects braking of the movement of the adjustment element with sliding coupling elements.

The braking effect here depends on the actuation of the coupling device, but also on tolerances in the system and on a wear for example of the coupling elements.

In an adjustment system for example of a vehicle side door great loads occur in operation. For example, a vehicle side door is subject to a multitude of opening and closing cycles, for example up to 100,000 opening and closing cycles, during which the adjustment system has to operate reliably.

It is desirable to detect, indicate and eventually (if possible) compensate wear e.g. due to system aging in operation. In addition, tolerances can exist in the system, which possibly should be taken into account in the actuation of the coupling device.

SUMMARY

It is an object of the present invention to provide an assembly and a method for adjusting an adjustment element relative to a stationary section of a vehicle, which provide for a diagnosis of the functionality before putting into operation, but also during the future operation.

This object is solved by an assembly for adjusting an adjustment element relative to a stationary section of a vehicle with features as described herein.

Accordingly, the control device is configured to calculate a force value or torque value acting on the coupling device with reference to an acceleration value obtained via the sensor device during an adjustment of the adjustment element in the slip state of the coupling device.

Based on the calculation of the force value or torque value, a diagnosis of the slip state of the coupling device can be effected. In particular, the force value or the torque value reveals what force acts on the coupling device with an existing actuation in the slip state.

For the purpose of diagnosis, the coupling device is switched into the slip state in particular at the beginning of an adjusting movement of the adjustment element or for braking the movement of the adjustment element. Depending on the actuation of the coupling device a force value or a torque value acts on the coupling device, which corresponds to the force value or torque vale transmitted for adjusting the adjustment element (in the case of an electromotive adjustment of the adjustment element) or to the force value or torque value acting on the coupling device for braking the adjustment element (when braking a for example manually adjusted adjustment element). This force value or torque value can be determined with reference to the (positive or negative) acceleration of the adjustment element, based on the finding that a positive acceleration of the adjustment element is caused by an adjusting force transmitted via the coupling device and vice versa a negative acceleration of the adjustment element corresponding to a braking operation is caused by a braking force caused by the coupling device. With reference to the measured acceleration of the adjustment element, the force transmitted to the coupling device for adjustment or the force applied to the coupling device for braking thus can be inferred.

In one aspect, the coupling device can have different states. In a coupling state, for example, the coupling element can couple the drive motor to the transmission element in order to transmit an adjusting force for adjusting the adjustment element from the drive motor to the transmission element and thereby to the adjustment element. In an uncoupling state, on the other hand, the coupling element is uncoupled, so that the drive motor also is uncoupled from the transmission element and the coupling device thus is in an idling state. The coupling device is in the coupling state in particular for an electromotive adjustment of the adjustment element, driven by the drive motor. On the other hand, the coupling device is in the uncoupling state to for example provide for a manual adjustment of the adjustment element, for example a vehicle door, by a user.

The force value or the torque value can be calculated in particular with reference to the acceleration value and a mass value indicating the mass of the adjustment element. When the mass of the adjustment element is known and the (current, in general time-variable) acceleration value is measured by the sensor device, the product of the acceleration and the mass provides the force (currently) acting on the adjustment element or (in the case of a pivotable adjustment element, for example a vehicle side door) the (current) torque acting on the adjustment element (in this case, the acceleration corresponds to an angular acceleration). When the coupling device is in its sliding slip state, the force transmitted via the coupling device for adjustment (in the case of an electromotive adjustment with a positive acceleration) or the braking force caused on the coupling device (when braking the adjustment element with a negative acceleration) thus can be inferred with reference to the measured acceleration.

The actuation of the coupling device for adopting the slip state generally is effected via the control device, which for this purpose brings coupling elements into (sliding) contact with each other for example with a predetermined force (with reference for example to a force value stored in the control device). The slip obtained in the slip state can also be measured here, in particular with reference to the rotational speed of the drive motor and the velocity of the adjustment element on adjustment. The rotational speed of the drive motor can be measured for example by a suitable speed sensor, for example a Hall sensor or the like, on the drive shaft of the drive motor. When the drive motor is coupled to the transmission element, the rotational speed of the drive motor corresponds to a desired velocity of the adjustment element, for example the vehicle door. The current velocity of the adjustment element, for example the angular velocity of a pivotable vehicle door, on the other hand can be determined via a suitable sensor device on the adjustment element (for example a sensor for determining the absolute angular position of the vehicle door or the angular velocity of the vehicle door), so that from the difference between the desired velocity (which with a completely produced coupling would be obtained with reference to the rotational speed of the drive motor) and the currently measured velocity the slip between the adjustment element and the drive motor can be inferred.

With reference to the calculated force value or torque value the control device can calibrate the actuation of the coupling device. For a particular actuation, for example for an actuation of the coupling device with a predetermined current, it can be stored in the control device what force value or what torque value is obtained, wherein the resulting slip can be stored in addition. When this is effected for different actuation parameters, for example for different current values for the actuation of the coupling device, a table can be deposited for example in the control device, in which actuation parameters are associated with a resulting force value or a torque value, so that in the further operation an actuation of the coupling device to obtain a particular force value or torque value (for the electromotive adjustment of the adjustment element or for braking the adjustment element) can be effected with reference to the stored calibration table.

The system can be self-learning. For this purpose, diagnostic routines can be carried out before putting into operation and/or regularly during the operation in order to (continuously) newly calibrate the control device and thus detect a change in the system, for example due to wear, and correspondingly adapt an actuation of the coupling device.

In the diagnosis, further measurement values or characteristic values can also be taken into account. For example, sensor signals of sensors present in or on the vehicle, such as inclination sensors, temperature sensors, acceleration sensors or force sensors, can be evaluated and be included in the diagnosis in order to for example also consider such sensor signals in the calibration. For example, a vehicle inclination or forces externally acting on the vehicle door, for example as a result of wind pressure, or the temperature in or on the vehicle, in this way can also be taken into account for the calibration.

Diagnostic routines can be carried out when starting the adjustment element or also when braking the adjustment element.

A first diagnostic routine regularly can be carried out at the beginning of an adjusting movement of the adjustment element, for example of a vehicle door. At the beginning of the adjusting movement, the control device therefor can switch the coupling device into its slip state, so that a transmission of an adjusting force to the adjustment element is effected with a slip at the beginning of the adjusting movement. The slip can be variable, in particular by more and more closing the coupling device and thus continuously reducing the slip from a maximum slip to 0 (wherein the maximum slip corresponds to the uncoupling state with idling coupling and a slip of 0 corresponds to the coupling state with completely coupled coupling elements). The resulting (variable) acceleration values at the adjustment element can be measured in order to determine the resulting variable force values or torque values at the coupling device. With varying slip it thus is determined what force or torque currently is transmitted via the coupling device, which correspondingly can be stored in the control device together with the associated actuation parameters of the coupling device and can be used for calibration.

Alternatively or in addition, a second diagnostic routine can regularly be carried out on braking of an adjusting movement of the adjustment element. To brake an adjusting movement of the adjustment element, for example when manually adjusting the adjustment element for limiting the adjustment speed, or to provide an end stop damping before reaching a completely open position, the coupling device is switched into the slip state, so that the coupling elements of the coupling device slidingly cooperate and cause a braking force on the adjustment element (for example with the drive motor standing still). With reference to the acceleration measured on the adjustment element via the sensor device, the braking force acting on the coupling device then can be inferred.

In turn, the actuation of the coupling device can be varied in order to obtain a variable slip at the coupling device. For example, in the second diagnostic routine the slip can be reduced continuously from a maximum slip to 0 (wherein the maximum slip in turn corresponds to the uncoupling state with idling coupling and a slip of 0 corresponds to the coupling state with completely coupled coupling elements). The measured force values or torque values can be stored in the control device together with the actuation parameters and can be used for calibration.

The object also is solved by a method for adjusting an adjustment element relative to a stationary section of a vehicle, in particular of a vehicle door relative to a vehicle body, including:

adjusting the adjustment element by using a drive motor, wherein an electrically actuatable coupling device couples the drive motor to a transmission element for adjusting the adjustment element via a coupling element, which in a slip state of the coupling device cooperates with a further coupling element or a transmission element such that a slip exists between the coupling element and the further coupling element or the transmission element, measuring an acceleration value of the adjustment element during an adjustment of the adjustment element by using a sensor device, and calculating a force value or torque value acting on the coupling device, by a control device, with reference to an acceleration value obtained via the sensor device during an adjustment of the adjustment element in the slip state of the coupling device.

Diagnostic routines as described above can be carried out in the manufacture or assembly of the adjustment element, e.g. of the vehicle door, hence in the production (e.g. as so-called end-of-line test as an operability test after the manufacture). Such diagnostic routines can, however, also be carried out during operation after delivery of the vehicle to a customer. The diagnostic routines can be executed under completely automatic control by the control device, wherein an adaptation of system parameters and a calibration of the system can be performed automatically by the control device and error messages can also be generated and indicated automatically. By using such diagnostic and control routines aging effects in the entire system of the adjustment element can be compensated and post-normalized, so that the operability of the adjustment system is obtained, possible malfunctions can be compensated and/or error messages can be generated in order to provide for maintenance.

BRIEF DESCRIPTION OF THE DRAWINGS

The idea underlying the invention will be explained in detail below with reference to the exemplary embodiments illustrated in the Figures.

DETAILED DESCRIPTION

Figure 1:
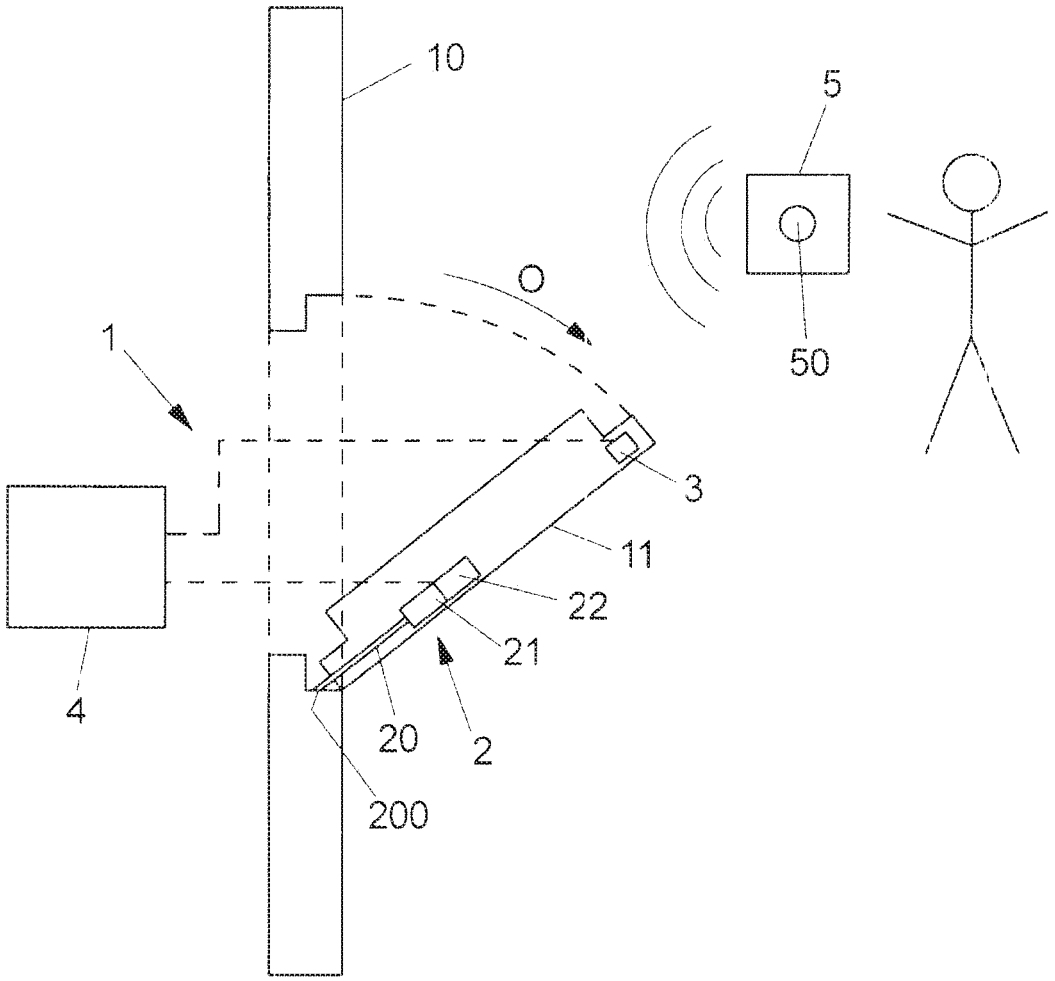
FIG. 1 shows a schematic view of an adjustment element in the form of a vehicle door on a stationary section in the form of a vehicle body.

FIG. 1 shows a schematic view of a vehicle 1 that includes a vehicle body 10 and an adjustment element in the form of a vehicle door 11, which is pivotable on the vehicle body 10 about a pivot axis along an opening direction O.

The adjustment element 11 can be realized for example by a vehicle side door or also by a liftgate. In a closed position the adjustment element 11 covers a vehicle opening 100 in the vehicle body 10, for example a transverse opening or a liftgate opening in the vehicle body 10.

It should be noted that the adjustment element 11 for example can also be shiftably arranged on the vehicle body 10, for example as a sliding door. What will be explained below analogously is also applicable to the adjustment element to be shifted.

By means of a driving device 2 the adjustment element 11 is electromotively movable from its closed position into an open position, so that the adjustment element 11 in the form of the vehicle door can be moved automatically in an electromotive way. The adjusting device 2, schematically illustrated in FIG. 1 and in an exemplary embodiment schematically shown in FIG. 2, includes a drive motor 22 which via a coupling device 21 is coupled to a transmission element 20, by means of which adjustment forces can be transmitted between the adjustment element 11 and the vehicle body 10. The drive motor 22 for example can be stationarily arranged on the adjustment element 11, while the transmission element 20 for example in the manner of a so-called catch strap is articulated to an end 200 and thus pivotally fixed to the vehicle body 10.

In a concrete aspect, the driving device 2 can be configured for example like in DE 10 2015 215 627 A1, whose content will fully be incorporated herein.

Figure 2:
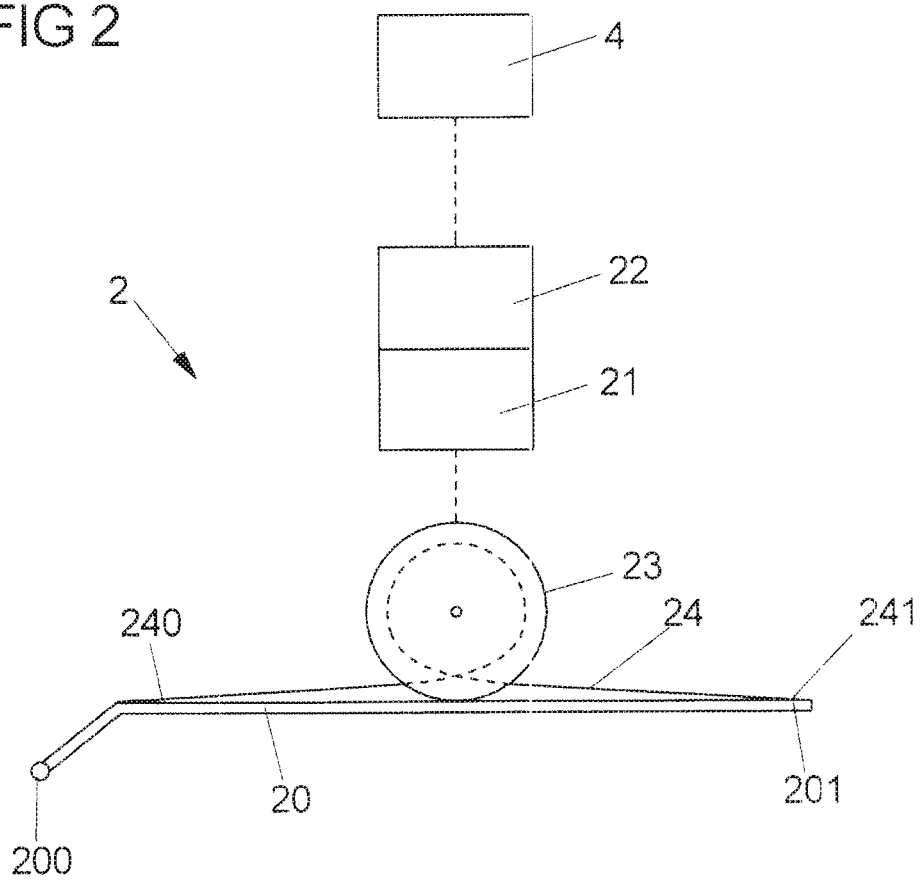
FIG. 2 shows a schematic view of an assembly with a drive motor, a coupling device, a control device and a transmission element for force transmission for adjusting the adjustment element.

In the exemplary embodiment of the driving device 2 as shown in FIG. 2 the drive motor 22 serves for driving a drive element 23 in the form of a cable drum, which via a coupling element 24 in the form of a flexible, slack pulling element, in particular in the form of a pull cable (for example a steel cable) formed to transmit (exclusively) tensile forces, is coupled to the transmission element 20. The cable drum 23 for example can be supported on the longitudinally extending transmission element 20 and roll off on the transmission element 20. The coupling element 24 is connected to the transmission element 20 via a first end 240 in the region of the end 200 of the transmission element 20 and via a second end 241 in the region of a second end 201 and slung around the drive element 23 in the form of the cable drum. When the drive element 23, driven by the drive motor 22, is put into a rotary movement, the coupling element 24 in the form of the pulling element (pull cable) rolls off on the drive element 23, so that the drive element 23 is moved relative to the transmission element 20 and thus along the longitudinal direction of the transmission element 20 relative to the transmission element 20, which leads to an adjustment of the adjustment element 11 relative to the vehicle body 10.

It should be noted at this point that other construction forms of driving devices also are conceivable and possible. For example, the drive motor 22 also can drive a pinion that is in meshing engagement with the transmission element 20. It is also conceivable and possible that the driving device is formed as a spindle drive for example with a rotatable spindle that is in engagement with a spindle nut.

The coupling device 21 serves to couple the drive motor 22 to the drive element 23 or to uncouple the same from the drive element 23. In a coupling state, the coupling device 21 produces a flux of force between the drive motor 22 and the drive element 23, so that a rotary movement of a motor shaft of the drive motor 20 is transmitted to the drive element 23 and accordingly the drive element 23 is put into a rotary movement in order to thereby introduce an adjusting force into the transmission element 20. In an uncoupling state, on the other hand, the drive motor 22 is uncoupled from the drive element 23, so that the drive motor 22 can be moved independent of the drive element 23 and inversely the drive element 23 can be moved independent of the drive motor 22. In this uncoupling state for example a manual adjustment of the adjustment element 11 can be possible without the drive motor 22 being loaded with forces.

Figure 3:
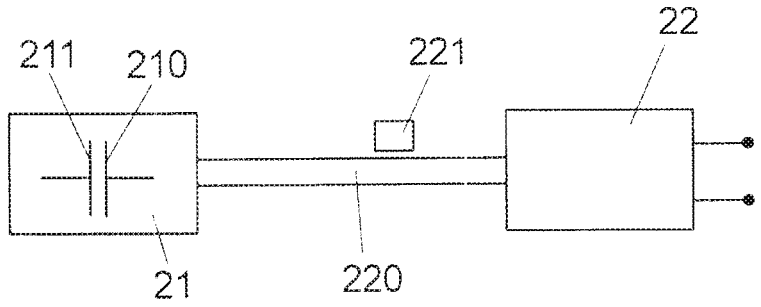
FIG. 3 shows a schematic view of a drive motor and a coupling device.

The coupling device 21 also has a slip state, corresponding to a sliding state in which coupling elements 210, 211, schematically shown in FIG. 3, slidingly are in contact with each other. A first coupling element 210 here is operatively connected with a motor shaft 220 of the drive motor 22, while a second coupling element 211 is operatively connected with the drive element 23. In this sliding slip state the coupling device 21 for example can provide a braking force during a manual adjustment of the adjustment element 11, caused by the sliding contact of the coupling elements 210, 211 with each other.

A control device 4 serves for controlling the adjusting device 2, in particular for actuating the drive motor 22 and the coupling device 21. By means of the control device 4 the coupling device 21 can be actuated in order to switch the coupling device 21 between its different states and therefor move the coupling elements 210, 211 relative to each other. In particular, in the uncoupling state the coupling elements 210, 211 are uncoupled from each other and thus can be moved independently, so that the coupling device 21 is in an idling state. In the coupling state, the coupling elements 210, 211 are pressingly urged in contact with each other and thus are non-positively connected with each other, so that an adjusting force can be transmitted without slip from the drive motor 22 to the drive element 23 and thereby to the transmission element 20. In the slip state, a slip exists between the coupling elements 210, 211, so that the coupling elements 210, 211 slide on each other and a rotary movement of the drive motor 22 is transmitted to the drive element 23 (in the form of the cable drum) with a slip.

For example, a user can initiate an opening operation via an actuating unit 5 in the form of a radio key, for example by a user pressing a button 50 of the actuating unit 5, thereby generating an opening signal that is communicated to the control device 4. When the control device 4 detects that the adjustment element 11 is to be opened, the control device 4 actuates the drive motor 22 and the coupling device 21 in order to produce a coupling between the drive motor 22 and the drive element 23 and thus introduce an adjusting force into the adjustment element 11 and in this way open the adjustment element 11 in the form of the vehicle door.

The adjustment element 11 in the form of the vehicle door, as can be taken from the schematic view of FIG. 1, includes a sensor device 3 that is configured to measure an (angular) acceleration value on the adjustment element 11 and also possibly to measure the absolute angular position and angular velocity of the adjustment element 11.

In addition, parameters of the drive motor 42 can be measured, for example via a speed sensor 221 in the form of a Hall sensor, as this is schematically illustrated in FIG. 3. Via such a speed sensor 221, a rotational speed of the motor shaft 220 in operation can be determined.

Measurement values obtained via the sensor device 3 in conjunction with a suitable actuation of the coupling device 21 can be used to carry out diagnostic routines for the diagnosis of the slip behavior of the coupling device 21 in the slip state in order to calibrate an actuation of the coupling device 21 and compensate possible changes in the system, for example due to aging effects or wear, or to determine a malfunction.

For the purpose of diagnosis, the control device 4 can be configured to switch the coupling device 21 into the slip state, so that the adjustment element 11 in the form of the vehicle door is accelerated for example from a rest position with slipping coupling. From the measured acceleration and from a known mass value of the adjustment element 11, the adjusting force transmitted with slipping coupling then can be inferred, so that a conclusion as to the state of the coupling device 21 can be made.

A diagnostic routine can be carried out for example on opening of the adjustment element 11 in normal operation, as this is illustrated in the sequence from FIGS. 4A-4E to FIGS. 7A-7E.

Figure 4A:
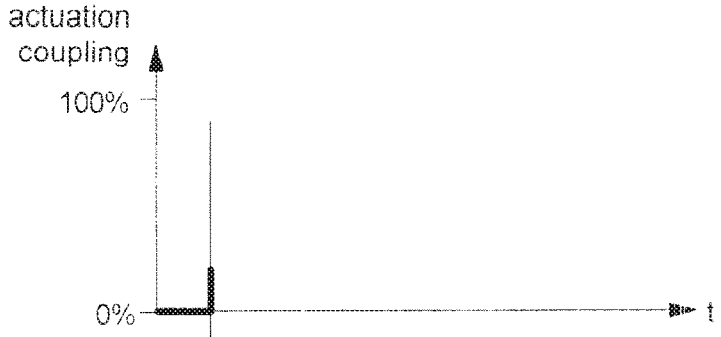
FIGS. 4A-4D show graphical views of the course of the actuation of the coupling, the position of the vehicle door, the resulting slip and the acceleration of the door up to a first point in time.
Figure 4B:
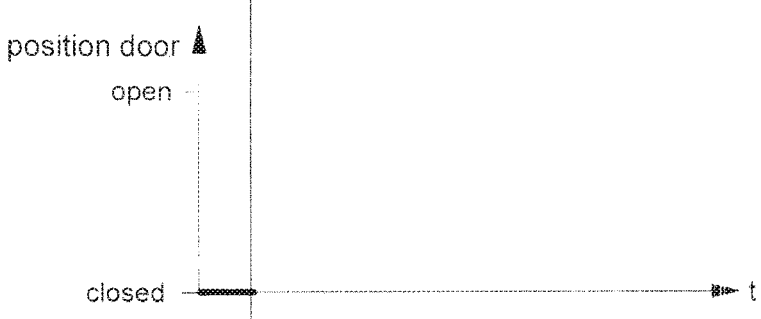
Figure 4C:
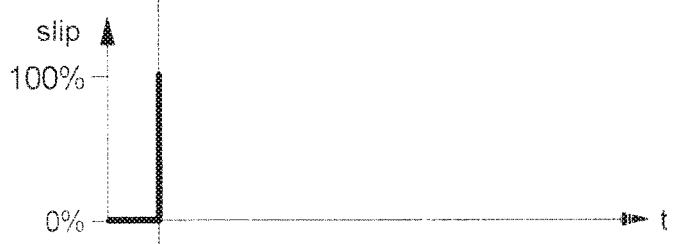
Figure 4D:
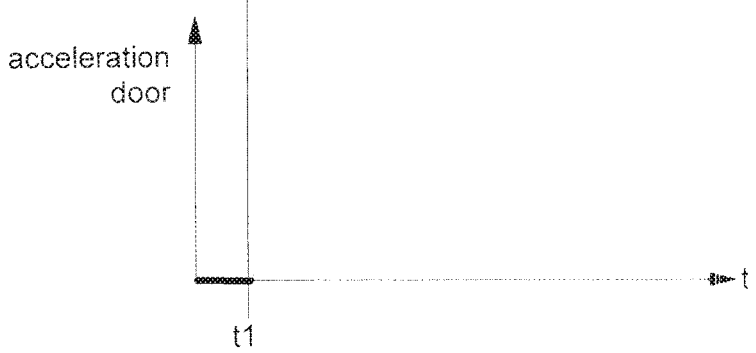
Figure 4E:
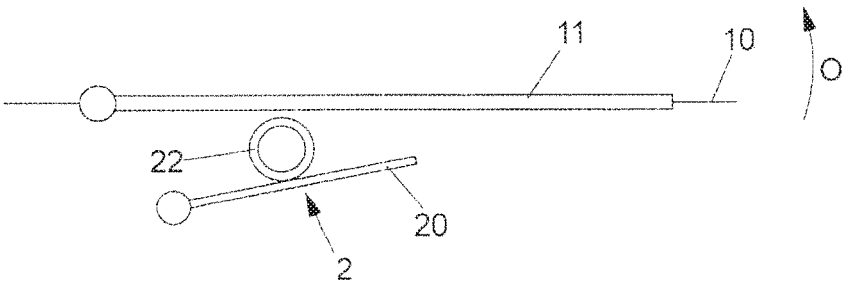
FIG. 4E shows a schematic view of the corresponding position of the vehicle door at the first point in time.
Figure 5A:
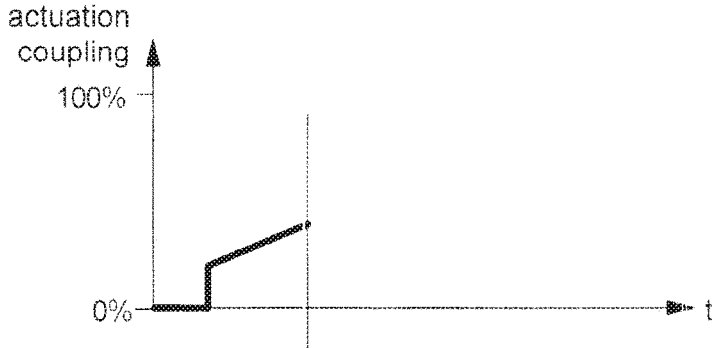
FIGS. 5A-5D show graphical views of the course of the actuation of the coupling, the position of the vehicle door, the resulting slip and the acceleration of the door up to a second point in time.
Figure 5B:
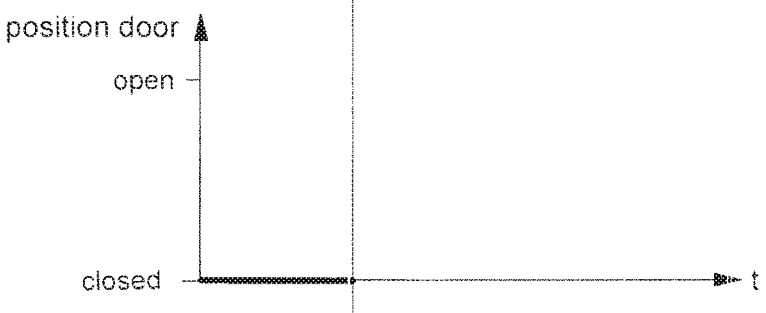
Figure 5C:
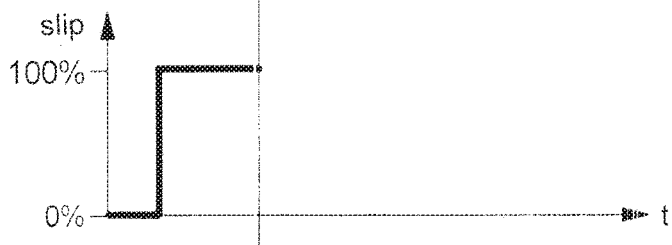
Figure 5D:
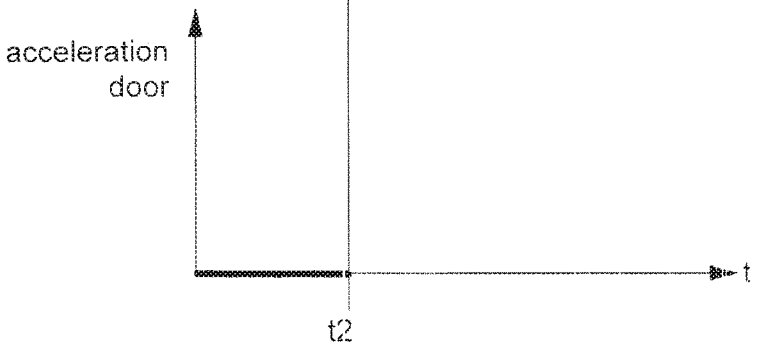
Figure 5E:
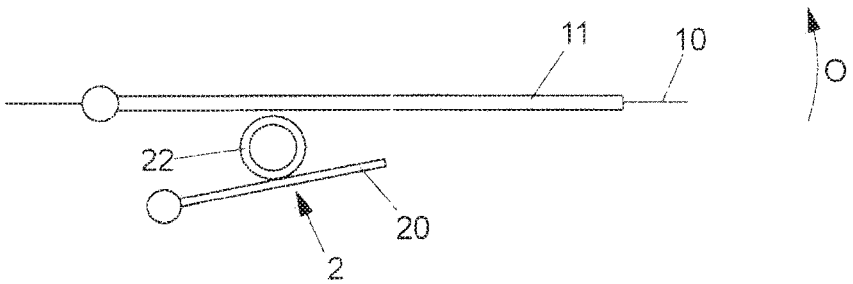
FIG. 5E shows a schematic view of the corresponding position of the vehicle door at the second point in time.
Figure 6A:
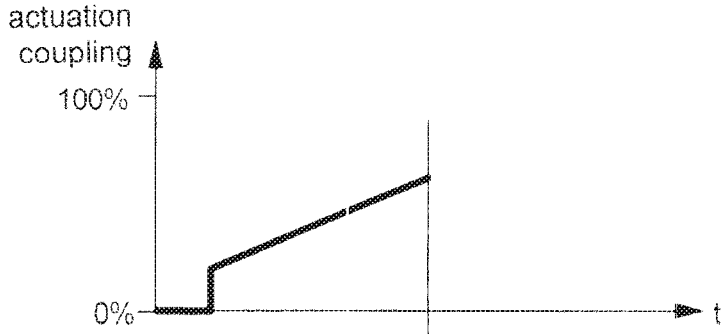
FIGS. 6A-6D show graphical views of the course of the actuation of the coupling, the position of the vehicle door, the resulting slip and the acceleration of the door up to a third point in time.
Figure 6B:
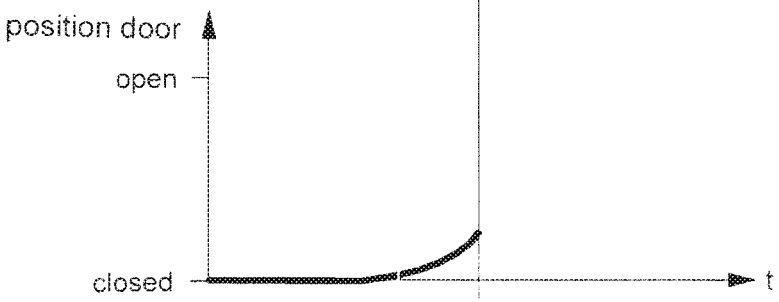
Figure 6C:
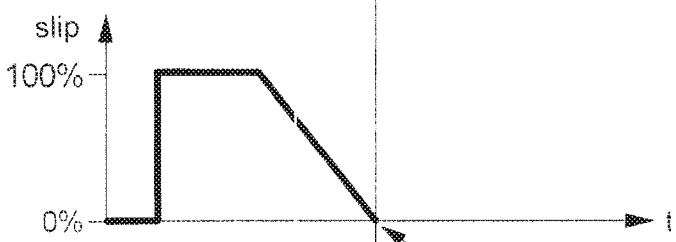
Figure 6D:
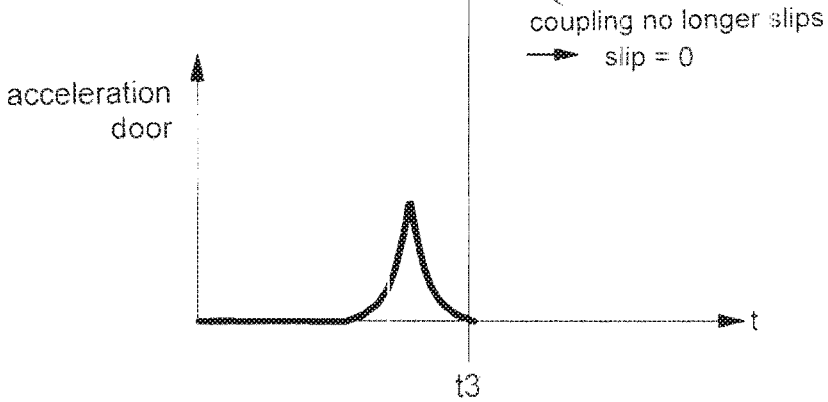
Figure 6E:
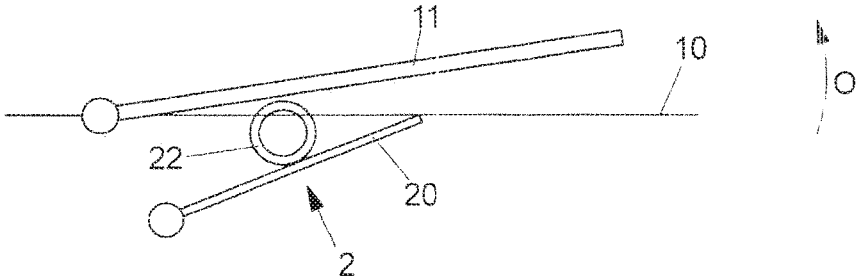
FIG. 6E shows a schematic view of the corresponding position of the vehicle door at the third point in time.
Figure 7A:
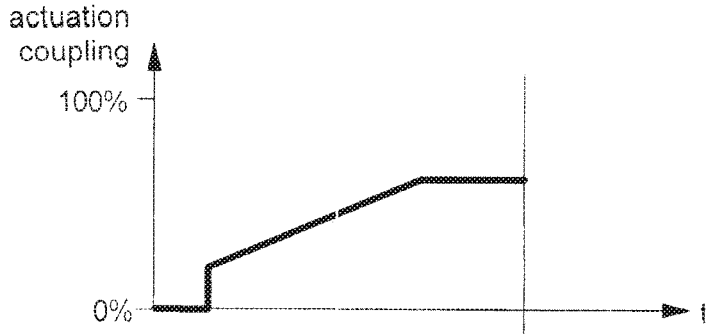
FIGS. 7A-7D show graphical views of the course of the actuation of the coupling, the position of the vehicle door, the resulting slip and the acceleration of the door up to a fourth point in time.
Figure 7B:
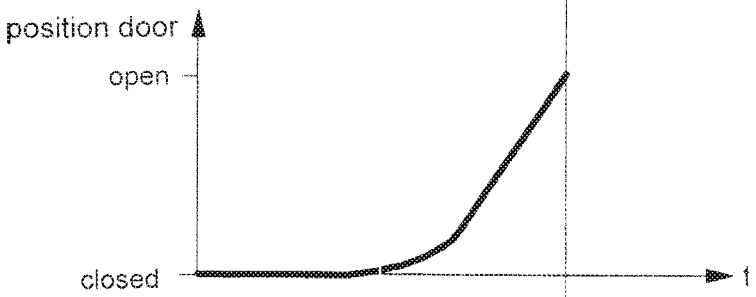
Figure 7C:
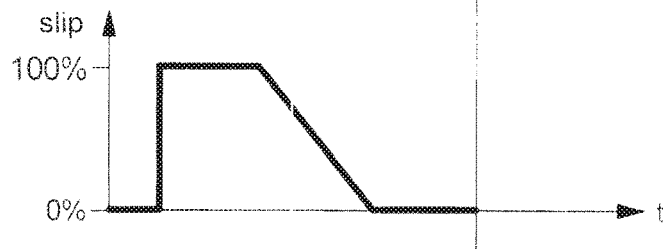
Figure 7D:
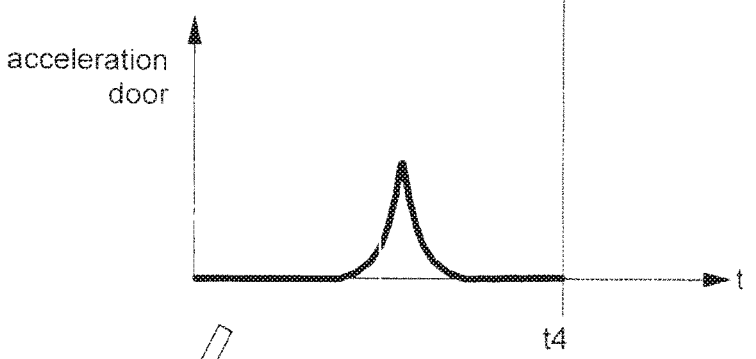
Figure 7E:
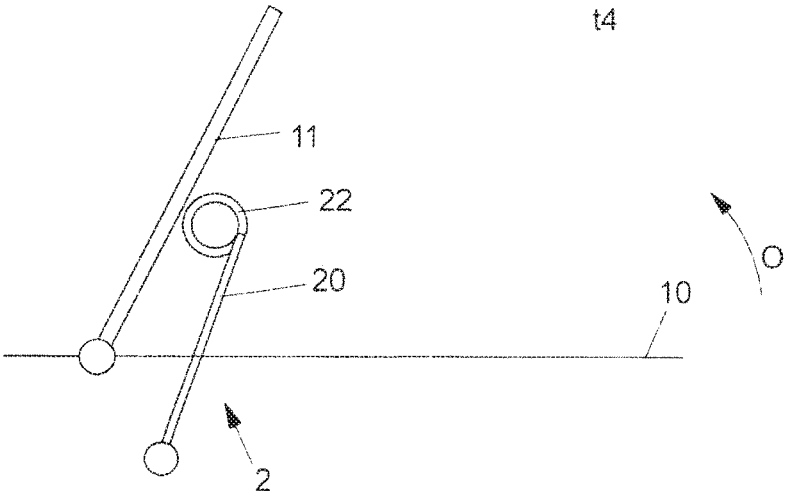
FIG. 7E shows a schematic view of the corresponding position of the vehicle door at the fourth point in time.

For opening the adjustment element 11 in the form of the vehicle door, the control device 4 can actuate the coupling device 21, so that the coupling device 21 is partly closed at a first point in time t1 and thus adopts a slip state corresponding to a partly energized coupling (see FIG. 4A). The adjustment element 11 initially is closed (see FIGS. 4B and 4E), and upon actuation of the drive motor 22 a maximum slip (of 100%) exists between the coupling elements 210, 211, corresponding to a standstill of the coupling element 211 associated with the drive element 23 as compared to the rotating coupling element 210 associated with the drive motor 22 (see FIG. 4C). An acceleration of the adjustment element 11 here is not yet effected (FIG. 4D).

The coupling device 21 now is continuously closed more and more, in that the coupling elements 210, 211 more and more are pressed in contact with each other, as this is shown in FIGS. 5A-5E and FIGS. 6A-6E. From the second point in time t2 a force is transmitted via the coupling device 21 from the drive motor 22 to the adjustment element 11, so that the adjustment element 11 is moved in the opening direction O (see FIGS. 6B and 6E) and the slip decreases continuously from 100% to 0% (see FIG. 6C). The resulting (angular) acceleration (FIG. 6D) initially increases, but then decreases again and is zero during the following adjusting movement at a constant adjustment speed (like at the fourth point in time t4 according to FIGS. 7A-7E).

In the phase of the acceleration of the adjustment element 11, corresponding to the period between the second point in time t2 and the third point in time t3, the adjusting force can be inferred with reference to the acceleration of the adjustment element 11, measured via the sensor device 3 on the adjustment element 11, which is introduced into the adjustment element 11 via the coupling device 21. In addition, with reference to the rotational speed of the drive motor 22, measured via the speed sensor 221, and the adjustment speed of the adjustment element 11, measured via the sensor device 3, the slip of the coupling device 21 can be determined. These values can be stored in the control device 4 together with actuation parameters of the coupling device 21, for example a current for energizing the coupling device 21, wherein due to the changing actuation of the coupling device 21 (corresponding to a slip reduced continuously from 100% to 0%) a changing adjusting force is obtained. Correspondingly, a table can be stored in the control device 1, which characterizes the slip behavior of the coupling device 21 depending on the actuation and in which actuation parameters of the coupling device 21 are deposited together with resulting slip values and resulting adjusting forces.

On actuation of the adjustment element 11 in the form of the vehicle door for opening purposes a positive acceleration is effected at the adjustment element 11. Another diagnostic routine can also be carried out on braking of the adjustment element 11 with a negative acceleration, in that the coupling device 21 is actuated on braking to adopt a slip state in order to determine resulting braking forces and store the same together with corresponding slip values. Such a diagnostic routine can be carried out for example in connection with an end stop damping during a manual adjustment of the adjustment element 11, in which the coupling device 21 is engaged before reaching an end stop associated with a maximally open position in order to brake the adjustment element 11.

Such diagnostic routines always can be carried out on opening and closing of the adjustment element 11 in the form of the vehicle door when an acceleration of the adjustment element 11 is obtained.

By means of such diagnostic routines, which can be carried out before putting into operation and also regularly during the operation, the adjustment system can be calibrated in order to compensate tolerances and consider aging effects for the operation. The system can be of the self-learning type in that a mode of operation of the coupling device 21 and a force transmission via the coupling device 21 is learned automatically. In normal operation, an actuation of the coupling device 21 then can be effected with reference to learned calibration data.

The idea underlying the invention is not limited to the preceding exemplary embodiments, but can also be realized in principle in a completely different way.

In particular, an adjusting device as described here for adjusting a vehicle side door, a liftgate or another adjustment element can be used in a vehicle. Such an adjustment element in principle can pivotally or also shiftably be arranged on the vehicle.

The adjustment system can be designed quite differently and is not limited to the exemplary embodiments described here. For example, a spindle drive or also a rack-and-pinion drive can be used, in order to adjust the adjustment element, wherein completely different embodiments, for example cable drives or the like, can also be used.

LIST OF REFERENCE NUMERALS

1 vehicle
10 stationary section (vehicle body)
100 vehicle opening
11 adjustment element (vehicle door)
2 driving device
20 transmission element (catch strap)
200, 201 end
21 coupling device
210, 211 coupling elements
22 drive motor
220 motor shaft
221 speed sensor (Hall sensor)
23 drive element
24 coupling element (pull cable)
240, 241 end
3 sensor device (acceleration sensor)
4 control device
5 actuating unit
50 control knob
O opening direction

The invention claimed is:

1. An assembly for adjusting an adjustment element relative to a stationary section of a vehicle, the assembly comprising:

a drive motor for electromotively adjusting the adjustment element, an electrically actuatable coupling device which includes a coupling element for coupling the drive motor to a transmission element for adjusting the adjustment element, wherein in a slip state of the coupling device a slip exists between the coupling element and a further coupling element or the transmission element, a sensor device for measuring an acceleration value of the adjustment element during an adjustment of the adjustment element, and a control device for controlling the drive motor and the coupling device, wherein the control device is configured to calculate a force value or torque value acting on the coupling device with reference to the acceleration value obtained via the sensor device during an adjustment of the adjustment element in the slip state of the coupling device.

2. The assembly according to claim 1, wherein the coupling device has a coupling state, in which the drive motor is coupled to the transmission element in order to exert an adjusting force on the transmission element for adjusting the adjustment element, and an uncoupling state in which the drive motor is uncoupled from the transmission element.

3. The assembly according to claim 1, wherein the control device is configured to calculate the force value or torque value with reference to the acceleration value and a mass value indicating the mass of the adjustment element.

4. The assembly according to claim 1, wherein the control device is configured to determine a slip value indicating the slip with reference to a rotational speed of the drive motor and a velocity of the adjustment element during the adjustment.

5. The assembly according to claim 1, wherein the control device is configured to calibrate an actuation of the coupling device with reference to the calculated force value or torque value.

6. The assembly according to claim 1, wherein the control device is configured to actuate the coupling device to adopt the slip state for carrying out a diagnostic routine.

7. The assembly according to claim 1, wherein the control device is configured to carry out a beginning diagnostic routine at the beginning of an adjusting movement of the adjustment element.

8. The assembly according to claim 7, wherein the control device is configured to vary an actuation of the coupling device for a variable slip of the coupling device in connection with the beginning diagnostic routine.

9. The assembly according to claim 7, wherein the control device is configured to continuously reduce the slip from a maximum slip to 0 in connection with the beginning diagnostic routine.

10. The assembly according to claim 1, wherein the control device is configured to carry out a braking diagnostic routine on braking of an adjusting movement of the adjustment element.

11. The assembly according to claim 10, wherein the control device is configured to vary the actuation of the coupling device for a variable slip of the coupling device in connection with the braking diagnostic routine.

12. The assembly according to claim 10, wherein the control device is configured to continuously reduce the slip from a maximum slip to 0 in connection with the braking diagnostic routine.

13. A method for adjusting an adjustment element relative to a stationary section of a vehicle, the method comprising:

adjusting the adjustment element by using a drive motor, wherein an electrically actuatable coupling device couples the drive motor to a transmission element for adjusting the adjustment element via a coupling element, which in a slip state of the coupling device cooperates with a further coupling element or the transmission element such that a slip exists between the coupling element and the further coupling element or the transmission element, measuring an acceleration value of the adjustment element during an adjustment of the adjustment element by using a sensor device, and calculating a force value or torque value acting on the coupling device by a control device with reference to the acceleration value obtained via the sensor device during the adjustment of the adjustment element in the slip state of the coupling device.

* * * * *